US005975639A

United States Patent [19]

Wilson et al.

[11] Patent Number: 5,975,639

[45] Date of Patent: Nov. 2, 1999

[54] ARMREST FOR ERGONOMIC CHAIR

[76] Inventors: John T. Wilson, 24559 Pappas Rd., Ramona, Calif. 92065; Milan Nechanicky, 14842 Booney SE., Westminster, Calif. 92683

[21] Appl. No.: 09/236,144

[22] Filed: Jan. 22, 1999

[51] Int. Cl.[6] ..... A47C 7/54

[52] U.S. Cl. ..... 297/411.35

[58] Field of Search ..... 297/411.34, 411.35, 297/411.37

[56] References Cited

U.S. PATENT DOCUMENTS

| | | | |
|---|---|---|---|
| 4,277,102 | 7/1981 | Aaras . | |
| 4,822,103 | 4/1989 | Stenvall . | |
| 5,288,130 | 2/1994 | Foster . | |
| 5,480,173 | 1/1996 | Koniecko . | |
| 5,612,718 | 3/1997 | Bryan | 297/411.35 X |
| 5,653,499 | 8/1997 | Goodall | 297/411.35 X |
| 5,655,814 | 8/1997 | Gibbs . | |
| 5,746,480 | 5/1998 | Bonutti | 297/411.35 |
| 5,884,974 | 3/1999 | Bergsten et al. | 297/411.35 |

*Primary Examiner*—Peter R. Brown
*Attorney, Agent, or Firm*—Brown, Martin Haller & McClain

[57] ABSTRACT

An adjustable armrest assembly for an ergonomic chair provides for adjustment of the armrests in the forward and rearward direction relative to the front of the chair without inhibiting adjustment of the armrests in other directions. A support frame having one or more rails or rods running perpendicular to the chair front is connected to the seat bottom. The support frame is slidably mounted on the seat bottom to permit sideways adjustment of the width between the chair arms. A support base, to which the chair arm is connected, is slidably supported on the rods. A controller attached to the support frame moves the support base along a line extending from the front to the back of the chair. In one embodiment, the controller includes a gear assembly and a screw drive attached to a manual crank. An expandable linkage is provided between the left and right support member so that both are simultaneously moved while still permitting width adjustment.

19 Claims, 3 Drawing Sheets

ARMREST FOR ERGONOMIC CHAIR

BACKGROUND OF THE INVENTION

In recent years, chairs have increasingly become ergonomically designed for comfort and healthful body support. Such chairs can be adjusted by the user to meet their specific anatomy. These adjustments include, for example, seat tilt, seat height, seat depth, seat glide, back height, and back tilt.

Armrests are usually designed to be secured in a fixed position on the chair. In an office environment, different people often use the same chair. Similarly, a person may perform several different tasks in the same chair. For example, a person may switch from writing on a desktop to working on a computer and prefer different arm positions for each task. Therefore, designers began constructing chairs with armrests that are adjustable to match the specific anatomy of a person while providing flexibility for quickly changing the armrests for another person or for the same person performing a different task.

Armrests in some chairs adjust vertically relative to the seat in order to accommodate variations in torso height and upper arm length. Also, armrests in some chairs adjust horizontally toward and away from the sides of the chair in order to accommodate variations in shoulder, torso, and buttock width. However, current armrests are unable to adjust horizontally forward and rearward relative to the front of the chair in order to accommodate variations in comfortable arm positioning.

The ability to adjust the armrests horizontally forward and rearward relative to the front of the chair has inherent problems since there are many other adjustments in an ergonomic chair. These other adjustments are controlled by an assortment of paddles and knobs located near the bottom of the seat. Due to the location of these paddles and knobs to the bottom of the seat, difficulties arise in positioning an apparatus near the bottom of the seat to permit unimpeded forward and rearward adjustment of the armrests. The configuration and mounting of the apparatus must allow enough room for the paddles and knobs to operate.

It would be desirable to provide an apparatus to adjust the horizontal armrest position forward and rearward relative to the front of the chair while providing clearance for other ergonomic adjustments on a chair. It would also be desirable to provide synchronized adjustment to both armrests in the forward and rearward direction relative to the front of the chair with only one control.

SUMMARY OF THE INVENTION

It is an advantage of the present invention to provide a means for adjusting the armrests in a chair horizontally forward and rearward relative to the front of the chair.

It is a further advantage of the present invention to provide a means for adjusting the armrests in a chair horizontally forward and rearward relative to the front of the chair while providing clearance for other ergonomic adjustments to the chair including but not limited to seat tilt, seat height, seat depth, back height, back tilt, armrest height, and armrest width.

Still another advantage of the present invention is to provide a means for synchronized adjustment to both armrests in the forward and rearward direction relative to the front of the chair with only one control.

In an exemplary embodiment, in a chair with left and right-side adjustable armrests, each adjustable armrest includes an arm support member, a rod, a screw drive, a support frame, and a geared adjustment member linked to the screw drive wherein the rod and the screw drive are disposed parallel to each other and retained within the support frame which, in turn, is mounted to the chair's seat. The support frame is slidably attached to the seat bottom so as to provide inward and outward movement to vary the width of the armrests. The arm support member is supported by the rod and can move axially along the rod. The arm support member has a threaded bore for cooperating with the threaded rod, such that, when a user turns the geared adjustment member, the screw drive rotates causing the arm support member to move forward and rearward relative to the front of the chair, depending upon the direction of rotation of the screw drive. The arm support member moves axially along both the rod and the screw drive to a plurality of different possible positions. A linkage element may be provided to link the geared adjustment members for the two adjustable armrests to provide synchronized adjustment to both adjustable armrests simultaneously forward and rearward relative to the front of the chair. The linkage is adapted to lengthen and shorten as needed to allow the adjustable armrests to adjust outward and inward from the sides of the chair.

In a first alternative embodiment, the geared adjustment member includes an electric motor. Forward and backward motion can be selected by providing a toggle switch or two separate buttons. In a second alternative embodiment, the screw drive can be replaced by a toothed belt or crank chain similar to a bicycle chain.

In a third embodiment, the screw drive is replaced by a second rod which allows the arm support member to move freely along both rods. In this embodiment, the adjustable armrests operate independently, without linkage or gearing. A locking screw is disposed on the arm support member to control the amount of friction between the arm support member and one of the rods. Tightening the locking screw prevents the free movement of the arm support member along both rods.

In a fourth alternative embodiment, both rods of the third embodiment may be replaced by a single rod.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
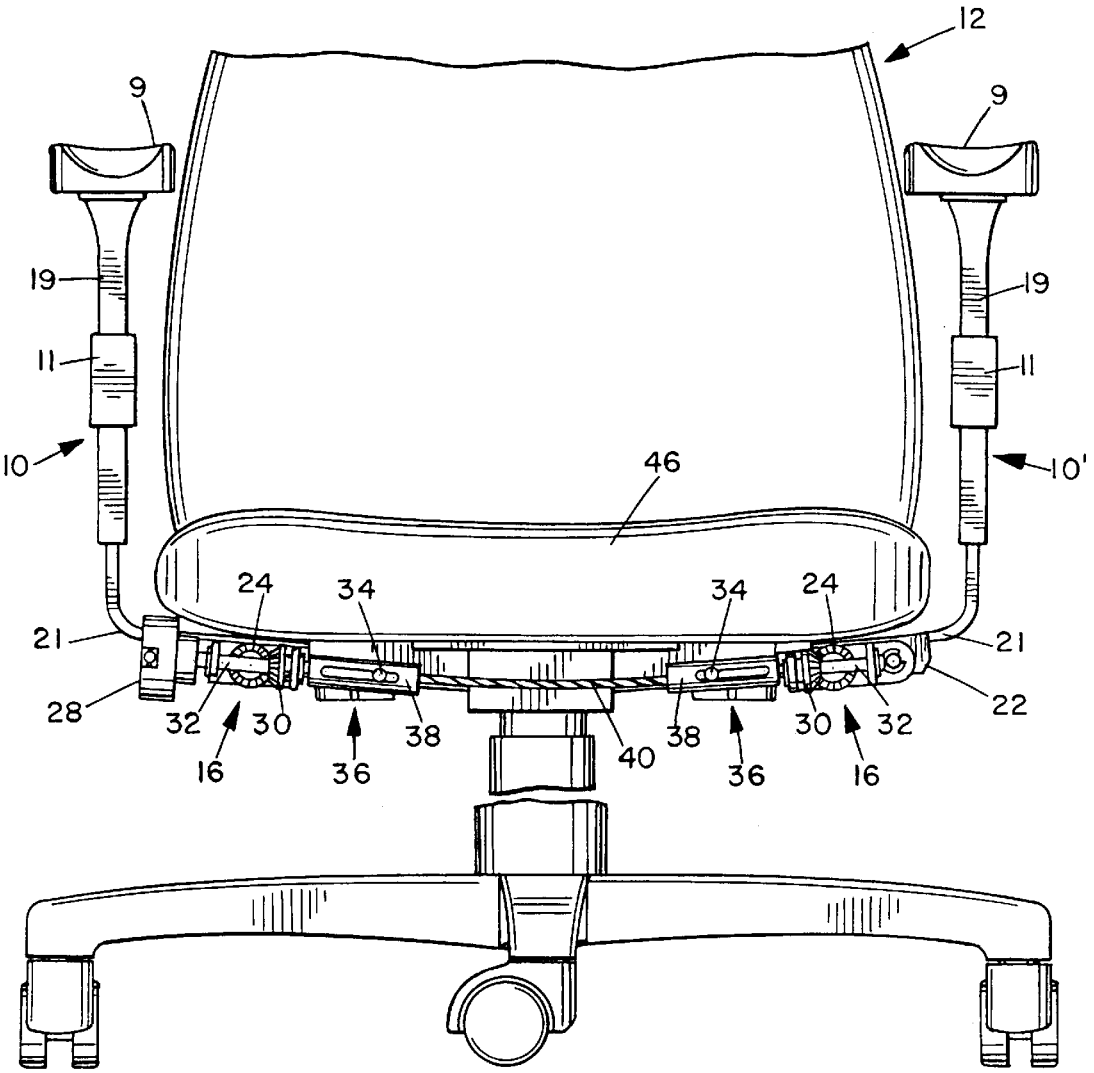
FIG. 1 is a front view of a typical chair incorporating the adjustable armrest adjustment mechanism.
Figure 2:
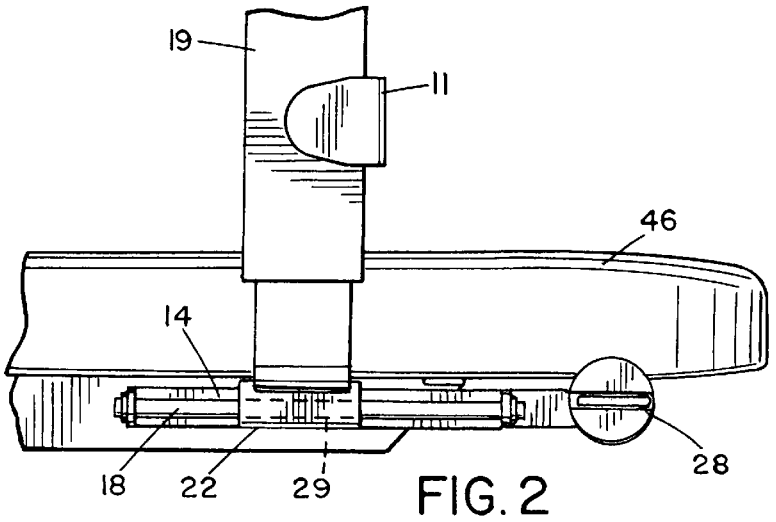
FIG. 2 is a partial side view of the chair and mechanism.
Figure 3:
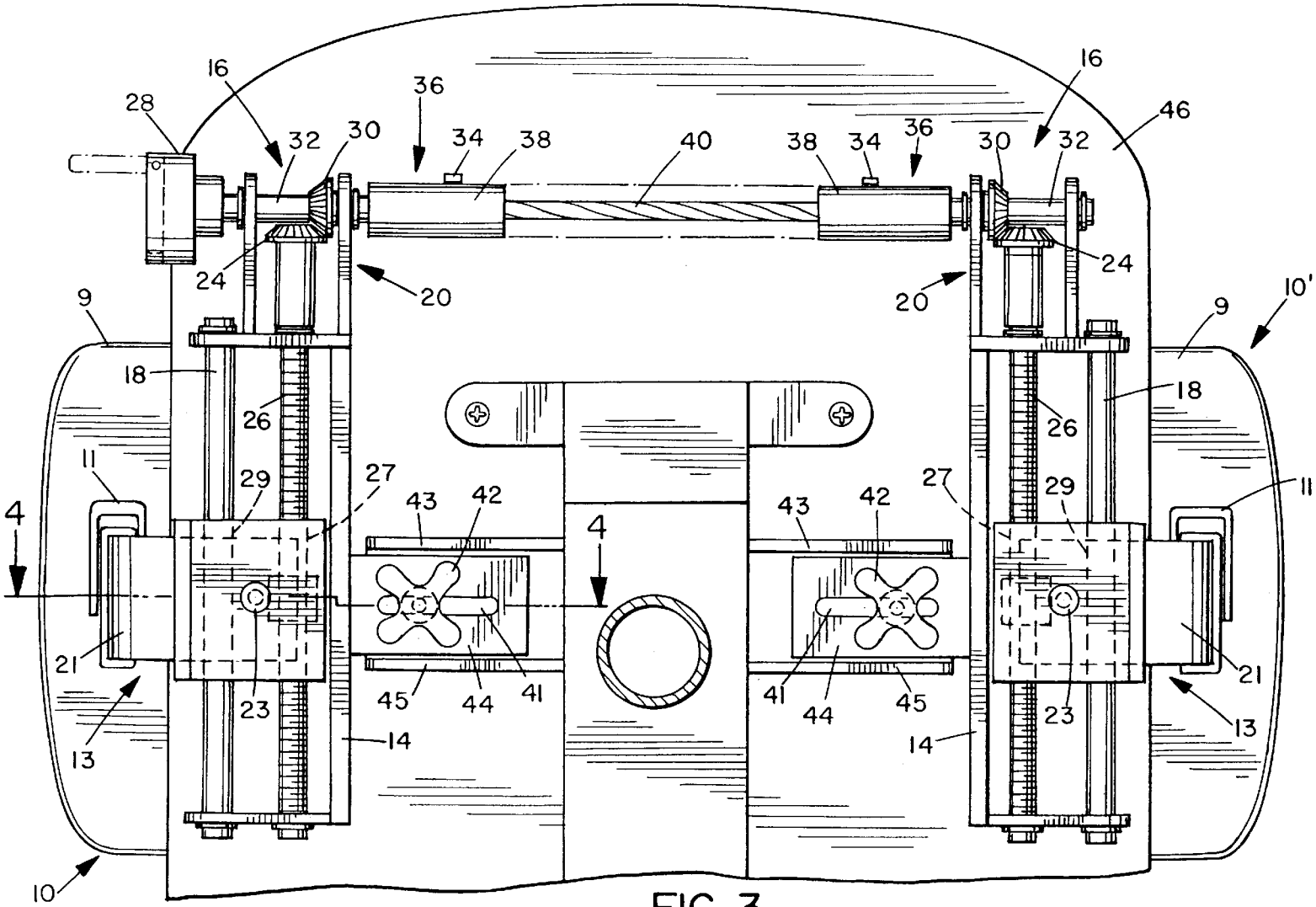
FIG. 3 is an enlarged underside view of the seat, showing the complete mechanism.
Figure 4:
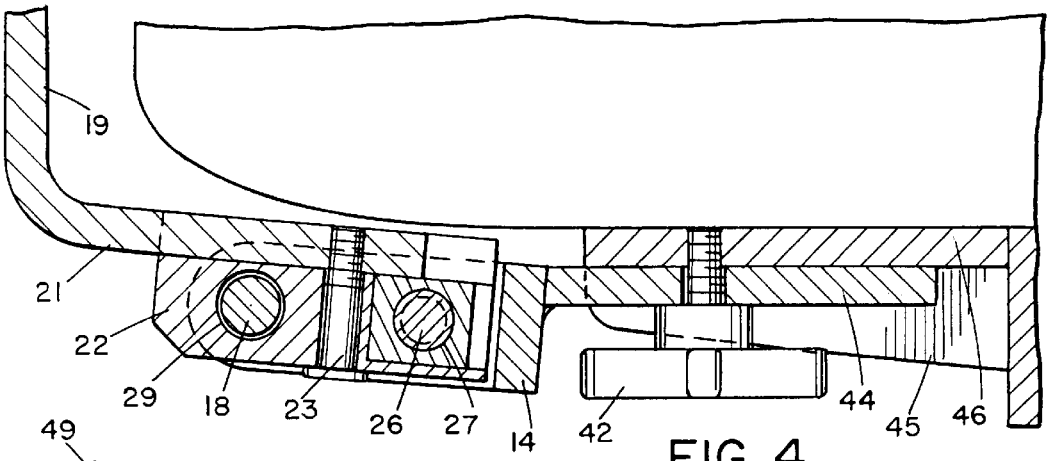
FIG. 4 is a further enlarged sectional view taken on line 4—4 of FIG. 3.

As illustrated in FIGS. 1 and 3, right and left adjustable armrests 10, 10' are mounted on chair 12. Chair 12 and its components are well known, examples of which are the conventional ergonomic chairs designed for use in the office environment, including secretarial chairs and computer chairs. To simplify the description, only the right adjustable armrest 10 will be described herein. Except where expressly stated, this description will apply equally for left armrest 10'.

As shown in FIG. 1, support frame 14 is mounted on a seat bottom 46 of chair 12. Support frame 14 is positioned on seat bottom 46 toward its sides such that frame 14 and the components attached thereto do not interfere with the function of other adjustment mechanisms for the chair, for example, seat height and tilt. Support frame 14 is formed from a plurality of generally flattened bars of metal, hard plastic or polymer, which extend downward from seat bottom 46, and a slotted flange 44 which extends toward the centerline of seat bottom 46. Flange 44 is slidable within a pair of guide rails 43, 45 attached to seat bottom 46 to permit adjustment of the distance between right and left armrests 10, 10'. Thumb screw 42 passes through slot 41 to screw into a threaded bore in seat bottom 46, providing means for locking the width adjustment once the desired width has been determined.

Support structure 13 comprises the lateral and vertical extensions which connect horizontal arm support 9, which may be molded and/or cushioned to fit the user's forearms, to the chair 12. The lateral extension includes support base 22 and lateral insert 21. Lateral insert 21 fits within a channel in support base 22 and is held in place by bolt 23. Alternatively, lateral insert 21 can be held in place by a screw or the like. Width adjustment between the right and left armrest 10, 10' can be provided by adjusting lateral insert 21 along the channel in support base 22. Bolt 23 provides means for locking the width adjustment once the desired width has been determined. Alternatively, insert 21 and support base 22 can be integrated into a single piece. Vertical extension 19 connects arm support 9 to insert 21 and may include a height adjustment 11, which can be a simple telescoping arrangement with a locking screw, a ratchet, or a series of notches and teeth to lock vertical extension 19 at the desired height once it is determined.

Rods 18 and 26 are supported by frame 14 so that they are maintained in a parallel relationship to each other along a line running from the front to the back of the seat bottom 46 and spaced slightly from the seat bottom 46. Rod 26, which is threaded, is supported such that it can be rotated, while rod 18 is fixed within frame 14. Support base 22 is adapted to move axially along rods 18 and 26, permitting support structure 13 to move forward or rearward relative to the front of seat bottom 46. Support base 22 has a pair of bores extending therethrough, or rounded channels extending thereacross, which permit a portion of support base 22 to move within the spacing between seat bottom 46 and rods 18, 26. Bore 27, which cooperates with rod 26, is threaded to match threads in rod 26 so that, as rod 26 rotates, support base 22 moves axially along rod 26. When the right and left armrests 10, 10' are linked, as will be described below, the thread orientations for the two armrests will be opposite each other, i.e., left-handed and right-handed.

Bore 29 corresponds to rod 18, both having smooth surfaces to permit easy movement of support base 22 along the front-to-back line of the chair. For purposes of this invention, rod 18 may have virtually any cross-sectional shape, and is not limited to a circular cross-section, but may be oval, square, rectangular, or any other polygon. Bore 29 will have a shape corresponding to the cross-sectional shape of rod 18. Bore 29 may be lined with a self-lubricating material, such as Teflon™ (tetrafluoroethylene) or high molecular weight polyethylene, or may have a light lubricant coating to minimize friction between the inner surface of bore 29 and rod 18. Alternatively, caged ball bearings or other friction-minimizing arrangements, which are known in the art, may be disposed around bore 29 to facilitate movement of support base 22. The combination of bore 29 and rod 18, in addition to providing lateral stability of the movement, acts as the primary weight bearing component for the armrest 10, so that the screw drive function of rod 26 and bore 27 is not impaired by downward force on the combination.

Support base 22 may be moved forward and rearward relative to the front of chair 12 through means retained within support frame 14. Geared adjustment member 16 controls support base 22 through a screw drive assembly 20. Screw drive assembly 20 comprises a screw drive gear 24 and threaded rod 26. As shown in FIG. 3, geared adjustment member 16 is disposed more toward the front of seat bottom 46 to facilitate access by the user. However, geared adjustment member 16 may be placed anywhere as long as it is not interfering with other adjustment mechanisms for the chair, for example, seat height and tilt. Geared adjustment member 16 comprises a knob 28, a pinion gear 30, a shaft 32 and a pin stop 34. Knob 28 is attached to the end of shaft 32 with pinion gear 30 concentrically attached to shaft 32. Pin stop 34 is attached perpendicularly to shaft 32 and substantially near the end of shaft 32 that is closest to the center of chair 12. Geared adjustment member 16 connects to support frame 14 so that when geared adjustment member 16 is rotated, pinion gear 30 rotates. Pinion gear 30 rotates screw drive gear 24 which rotates threaded cylindrical rod 26. A number of other gear drive arrangements are well known, and a person of ordinary skill in the art would recognize that alternative gear assemblies may be used to provide the desired movement.

A user moves support base 22 forward or rearward relative to the front of chair 12 by turning knob 28 which causes both shaft 32 and pinion gear 30 to rotate which also rotates threaded rod 26. When rod 26 rotates, its thread cooperates with the matching thread of bore 27 to cause support base 22 to move forward and rearward along the longitudinal axis of screw drive assembly 20. Alternatively, bore 27 is unthreaded and the thread of rod 26 cooperates with a fixed pin disposed within support base 22. The fixed pin cooperates with the threads of threaded cylindrical rod 26 to cause support base 22 to move forward and rearward along the longitudinal axis of screw drive assembly 20.

Right and left adjustable armrest 10, 10' move simultaneously forward and rearward relative to the front of chair 12 while allowing right and left adjustable armrest 10, 10' to adjust toward and away from the sides of chair 12 through linkage element 36. Linkage element 36 comprises a slotted cylinder 38 and a link 40 which, as shown in FIG. 1, are disposed on shaft 32 in a telescopic fashion. Slotted cylinder 38 is disposed concentrically around shaft 32 of geared adjustment member 16 at the end closest to the center of chair 12 such that slotted cylinder 38 moves freely along geared adjustment member 16. Pin stop 34 prevents slotted cylinder 38 from moving past the end of geared adjustment member 16 while providing force to turn slotted cylinder 38 when geared adjustment member 16 is rotated. Link 40, which may be a steel cable or any rod-like structure that is capable of transferring the torque applied during movement, is fixedly attached to slotted cylinder 38 at the end closest to the center of chair 12. Slotted cylinder 38 comprises a cylindrical tube closed at one end. The cylindrical tube may be formed of a substantially rigid material, such as metal or high-strength plastic, substantially forming a cylinder. The portion near the ends of the cylindrical tube has a slot formed therein which pin stop 34 slides freely between the ends of slotted cylinder 38 to accommodate width adjustment of chair 12. Cylinder 38 and pin stop 34 should be strong enough to withstand the applied torque during movement.

Figure 5:
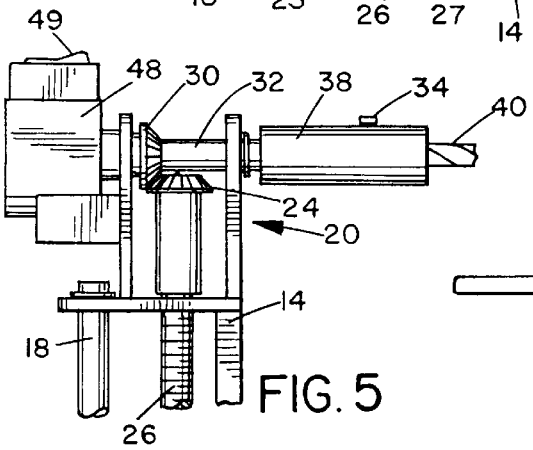
FIG. 5 is similar to a portion of FIG. 3, but showing a motor drive.

A first alternative embodiment of the present invention is illustrated in FIG. 5 wherein gear adjustment member 16 comprises a motor 48, a shaft 32, a pinion gear 30 and a pin stop 34. Motor 48 provides mechanical force to move adjustable armrest for ergonomic chair 10 forward and rearward relative to the front of chair 12 instead of manual force. Motor 48 is activated and deactivated through a toggle switch 49. Toggle switch 49 may have three positions wherein a first position activates motor 48 to move adjustable armrest 10 forward, a second position activates motor 48 to move adjustable armrest 10 rearward and a third position deactivates motor 48 to fix the position of adjustable armrest 10. Alternatively, a set of two buttons may be used to activate and deactivate motor 48. A first button activates motor 48 to move adjustable armrest 10 forward and a second button activates motor 48 to move adjustable armrest 10 rearward. Motor 48 is deactivated to fix the position of adjustable armrest 10 when neither button is pressed. A number of other activation and deactivation arrangements are well known, and a person of ordinary skill in the art would recognize that alternative activation and deactivation assemblies may be used to provide the desired movement.

Figure 6:
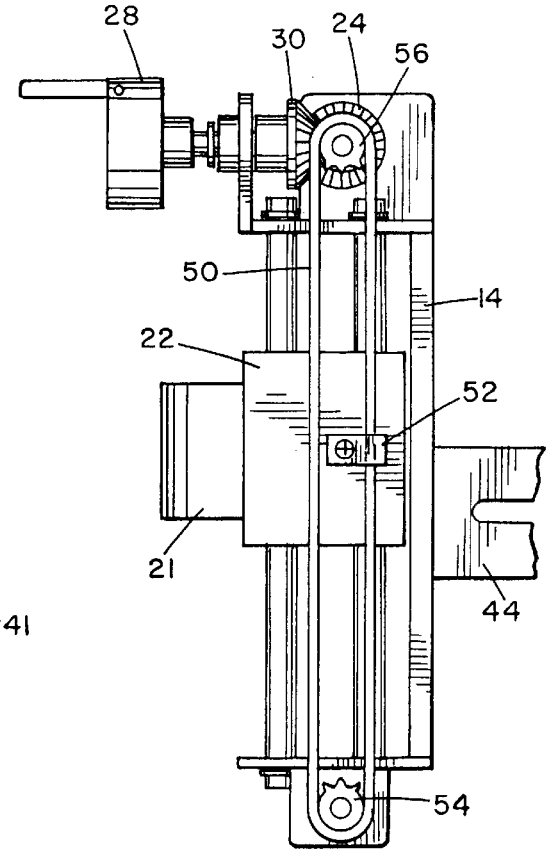
FIG. 6 is similar to a portion of FIG. 3, but showing a toothed belt or chain drive.

The second alternative embodiment of the present invention is illustrated in FIG. 6 wherein screw drive assembly 20 is replaced by a crank chain 50 similar to a bicycle chain. Alternatively, crank chain 50 can be a toothed belt. A chain fastener 52 attaches support base 22 to a fixed point on crank chain 50. A frame gear 54 is disposed on support frame 14 such that crank chain 50 is allowed to move forward and rearward. An adjustment gear 56 is disposed on support frame 14 and is geared to rotate when pinion gear 30 rotates. An activator such as a knob 28 or motor 48, provides rotation when activated for rotating pinion gear 30 which also rotates adjustment gear 56. This rotation causes crank chain 50 to move support base 22 forward and rearward when crank chain 50 moves forward and rearward.

Figure 7:
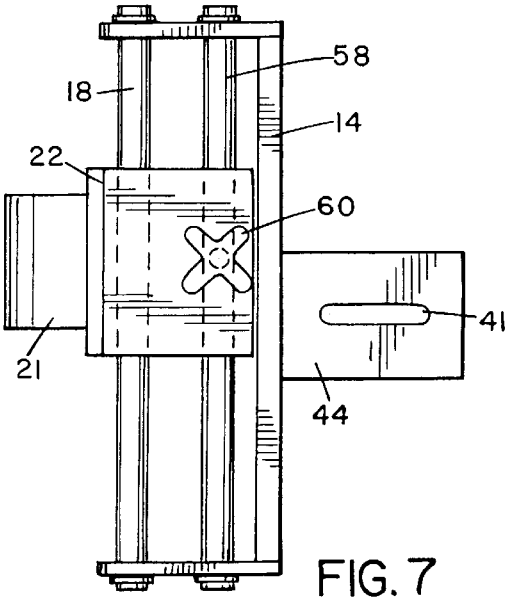
FIG. 7 is a similar view showing a manual adjustment structure.

The third alternative embodiment of the present invention is illustrated in FIG. 7 wherein geared adjustment member 16 and linkage element 36 of previous embodiments are omitted, and screw drive assembly 20 is replaced by a second rod 58 which allows support base 22 to move freely along both rod 18 and second rod 58. Geared adjustment member 16 of the previous embodiments is replaced by a support member locking screw 60. Bore 62 runs through the lower surface of support base 22 such that it is perpendicular to bore 27' and, therefore, to second rod 58. Bore 62 is internally threaded to match threads on locking screw 60. Support member locking screw 60 controls the amount of friction between support base 22 and second rod 58. When locking screw 60 is screwed to its fullest possible extent into support base 22, the locking screw 60 contacts second rod 58. Tightening support member locking screw 60 prevent the movement of support base 22 along both rod 18 and second rod 58. As disclosed with regard to the first embodiment, it would be desirable to provide friction-reducing surfaces on the walls of bores 27' and 29 to facilitate sliding of support base 22 along the two rods. Exemplary friction-reducing surfaces include Teflon™, high molecular weight polyethylene, ball bearings, etc.

While the stability of using two rods may be preferable, a possible variation of the third alternative embodiment illustrated in FIG. 7 eliminates rod 18 and its corresponding bore. In such a configuration, it may be desirable to provide a guide rail close to the side of the support base and parallel to rod 58 to prevent any slight angular deviation of support base 22 relative to the rod which might cause binding when adjustment is attempted.

It will be apparent to those skilled in the art that various modifications and variations can be made in the apparatus of the present invention without departing from the spirit or scope of the invention. Thus, it is intended that the present invention cover the modification and variations of this invention provided they come within the scope of the appended claims and their equivalents.

We claim:

1. An adjustable armrest which is mounted to an ergonomic chair, the chair having a seat portion with a seat front, a seat rear, a left side, a right side, and a seat bottom, the adjustable armrest comprising:

a support frame disposed on said seat bottom, said support frame comprising at least two rods disposed parallel to a front-to-back line running from said seat front to said seat rear, at least one rod corresponding to each of said left side and said right side;

a pair of arm support members having a substantially horizontal portion, and a vertical portion extending downward from said substantially horizontal portion, one arm support member corresponding to each of said left side and said right side;

a pair of movable support bases, one support base disposed at a lower end of said vertical portion of each arm support member and movably disposed on said at least one rod; and a single controller extending between said support bases for moving said pair of movable bases along the front-to-back line wherein activation of the controller causes the pair of arm support members to be moved relative to said seat portion.

2. An adjustable armrest as in claim 1, wherein said at least one rod comprises a rotatable threaded cylindrical rod and the support base has a threaded bore running therethrough for cooperating with said threaded rod, and said controller comprises:

a gear assembly adapted to rotate said threaded rod, wherein activation of said gear assembly causes the corresponding support base to move parallel to said front-to-back line.

3. An adjustable armrest as in claim 2, wherein said controller further comprises a rotatable knob for activating said gear assembly.

4. An adjustable armrest as in claim 2, wherein said controller further comprises a drive motor disposed on said gear assembly for activating said gear assembly.

5. An adjustable armrest as in claim 2, further comprising a linkage between said gear assembly on each of said left side and said right side of said seat portion and further comprising a drive means disposed adjacent one of said left side and said right side for simultaneously moving said pair of arm support members when said drive means is activated.

6. An adjustable armrest as in claim 5, wherein said linkage has at least one telescoping portion wherein a distance between said support bases on said left side and said right side may be adjusted.

7. An adjustable armrest as in claim 2, wherein said at least two rods further comprises a support rod corresponding to each of said left side and said right side, said support rod having a substantially smooth surface, wherein said support base slides along said support rod when said rotatable threaded cylindrical rod is rotated.

8. An adjustable armrest mounted on an ergonomic chair and which is attachable to a seat of a chair body, said seat having a seat front, a seat rear, a left side, a right side, and a seat bottom, and said adjustable armrest capable of being moved horizontally forward and rearward relative to said seat front, the adjustable armrest comprising:

a pair of arm support members disposed of laterally of said chair seat having a substantially horizontal portion, a vertical portion extending downward from said substantially horizontal portion, and a base portion disposed at a lower end of said vertical portion, one arm support member corresponding to each of said left side and said right side;

a pair of support frames disposed on said seat bottom, one support frame corresponding to each of said left side and said right side, said support frame having a front side and a rear side, each support frame comprising at least one rod disposed parallel to each of said left and said right side and adapted to allow said base portion of said arm support member to move horizontally forward and rearward relative to said seat front; and a single controller operably connected between said support bases for adjustably positioning said pair of arm support members horizontally forward and rearward relative to the seat front of said chair body.

9. An adjustable armrest as in claim 8, wherein said at least one rod comprises a rotatable threaded cylindrical rod, wherein said base portion has a threaded bore running therethrough for cooperating with said rotatable threaded cylindrical rod, and said controller comprises:

a geared adjustment member cooperating with said rotatable threaded cylindrical rod for controlling the rotation of said rotatable threaded cylindrical rod when said geared adjustment member is activated.

10. An adjustable armrest as in claim 9, further comprising a linkage element attached to said geared adjustment element on each of said left side and said right side of said seat portion and further comprising a drive means disposed adjacent one of said left side and said right side for simultaneously moving said pair of arm support members when said drive means is activated.

11. An adjustable armrest as in claim 10, wherein said linkage element has at least one telescopic portion wherein a distance between said support bases on said left side and said right side may be adjusted.

12. An adjustable armrest for ergonomic chair as in claim 9, further comprising a rotatable knob for activating said geared adjustment member.

13. An adjustable armrest as in claim 9, further comprising a drive motor disposed on said geared adjustment member for activating said geared adjustment member.

14. An adjustable armrest as in claim 9, wherein said at least one rod further comprises a support rod corresponding to each of said left side and said right side, said support rod having a substantially smooth surface, wherein said support base slides along said support rod when said rotatable threaded cylindrical rod is rotated.

15. An adjustable armrest as in claim 8, wherein said at least one rod comprises a support rod having a substantially smooth surface, wherein said base portion slides along said support rod, and said support frame further comprises:

a chain member disposed on said support frame substantially parallel to said support rod comprising:

a pair of gears disposed on said support frame, wherein one gear is disposed on the front side of said support frame and the other gear is disposed on the back side of said support frame; and a chain fixedly attached to said base portion, wherein said chain cooperates with said pair of gears to permit said chain to move horizontally forward and rearward relative to the seat front; and said controller comprises a geared adjustment member cooperating with said pair of gears and an activator, said geared adjustment member is adapted to rotate said pair of gears, wherein activation of said geared adjustment member by said activator causes said corresponding support member to move horizontally forward and rearward relative to the seat front.

16. An adjustable armrest as in claim 15, further comprising a linkage element attached to said geared adjustment element on each of said left side and said right side of said seat portion and further comprising a drive means disposed adjacent one of said left side and said right side for simultaneously moving said pair of arm support members when said drive means is activated, wherein said linkage element has at least one telescopic portion wherein a distance between said support bases on said left side and said right side may be adjusted.

17. An adjustable armrest as in claim 8, wherein said at least one rod comprises a support rod having a substantially smooth surface, wherein said base portion slides along said support rod, and said controller comprises:

a locking screw disposed on said base portion, said locking screw cooperating with a threaded bore through said base portion wherein said locking screw is adapted to contact said support rod when fully screwed into said base portion.

18. An adjustable armrest as in claim 8, wherein said at least one rod comprises a rotatable threaded cylindrical rod, wherein said base portion has a bore running therethrough for cooperating with said rotatable threaded cylindrical rod; wherein said bore has a pin disposed within for cooperating with said rotatable threaded cylindrical rod, and said controller comprises:

a geared adjustment member cooperating with said rotatable threaded cylindrical rod for controlling the rotation of said rotatable threaded cylindrical rod when said geared adjustment member is activated.

19. An adjustable armrest which is mounted to an ergonomic chair, attachable to a seat of a chair body, said seat having a seat front, a seat rear, a left side, a right side, and a seat bottom, and said adjustable armrest capable of being moved horizontally forward and rearward relative to said seat front, the adjustable armrest comprising:

a pair of arm support members disposed of laterally of said chair seat having a substantially horizontal portion, a vertical portion extending downward from said substantially horizontal portion, and a base portion disposed at a lower end of said vertical portion, one arm support member corresponding to each of said left side and said right side, wherein said base portion comprises a metal rectangular block wherein a smooth bore and a threaded bore run therethrough, wherein both said smooth bore and said threaded bore run substantially parallel to said left side and said right side;

a pair of support frames disposed on said seat bottom, one support frame corresponding to each of said left side and said right side, said support frame having a front side and a rear side, each support frame comprising at least one rod disposed parallel to each of said left and said right side and adapted to allow said base portion of said arm support member to move horizontally forward and rearward relative to said seat front wherein said at least one rod comprises:

a rotatable threaded cylindrical rod adapted for cooperating with said threaded bore of said base portion for moving said support member horizontally forward and rearward relative to said seat front, said rotatable threaded cylindrical rod having a front end and a rear end;

a drive gear concentrically disposed on said front end of said rotatable threaded cylindrical rod;

a support rod having a substantially smooth surface for cooperating with said smooth bore, wherein said base portion slides along said support rod when said rotatable threaded cylindrical rod is rotated; and a controller for positioning said pair of arm support members horizontally forward and rearward relative to the seat front of said chair body, wherein said controller comprises:

a geared adjustment member cooperating with said rotatable threaded cylindrical rod for controlling the rotation of said rotatable threaded cylindrical rod when said geared adjustment member is activated, further comprising:

a shaft disposed within said support frame substantially perpendicular to said rotatable threaded cylindrical rod, said shaft having an outer end and an inner end; and a shaft gear concentrically disposed on said outer end of said shaft and substantially perpendicular to said drive gear, wherein said shaft gear cooperates with said drive gear for controlling the rotation of said drive gear;

a rotatable knob for activating said geared adjustment member disposed on the outer end of said shaft of one of said pair of support frames; and a linkage element attached to the inner end of said shaft of each of said left side and said right side of said seat portion for simultaneously moving said pair of arm support members when said geared adjustment member is activated and further comprising:

a pair of telescoping connectors disposed on the inner end of said shaft, one telescoping connector corresponding to each of said support frames, said telescoping connector having an open end and a closed end wherein a distance between said support bases on said left side and said right side may be adjusted; and a cable disposed on said closed end of each said telescoping connector.

* * * * *